US011156134B2

(12) United States Patent
Schneider et al.

(10) Patent No.: US 11,156,134 B2
(45) Date of Patent: Oct. 26, 2021

(54) HYDRAULIC DRIVE FOR ACCELERATING AND BRAKING DYNAMICALLY MOVING COMPONENTS

(71) Applicants: EMPA Eidgenossische Material-prufungs- Und Forschungsanstalt, Dubendorf (CH); Wolfgang Schneider Ingenieurburo, Thun (CH)

(72) Inventors: Wolfgang Schneider, Thun (CH); Patrik Soltic, Uhwiesen (CH); Andyn Omanovic, Uster (CH)

(73) Assignees: EMPA Eidgenössische Materialprüfungs-Und Forschungsanstalt; Wolfgang Schneider Ingenieurbüro

( * ) Notice: Subject to any disclaimer, the term of this patent is extended or adjusted under 35 U.S.C. 154(b) by 0 days.

(21) Appl. No.: 16/615,175

(22) PCT Filed: May 18, 2018

(86) PCT No.: PCT/EP2018/063075
§ 371 (c)(1),
(2) Date: Aug. 20, 2020

(87) PCT Pub. No.: WO2018/215335
PCT Pub. Date: Nov. 29, 2018

(65) Prior Publication Data
US 2021/0003045 A1 Jan. 7, 2021

(30) Foreign Application Priority Data
May 22, 2017 (EP) ..... 17172231

(51) Int. Cl.
*F01L 9/10* (2021.01)
*F01L 1/26* (2006.01)
*F01L 1/46* (2006.01)

(52) U.S. Cl.
CPC ..... *F01L 9/10* (2021.01); *F01L 1/26* (2013.01); *F01L 1/462* (2013.01)

(58) Field of Classification Search
CPC ... F01L 1/462; F01L 1/465; F01L 9/02; F01L 2009/028; F01L 2013/105; F01L 25/02; F01L 33/02; F01L 2820/033
(Continued)

(56) References Cited

U.S. PATENT DOCUMENTS

2004/0035388 A1* 2/2004 Diehl ..... F01L 9/02 123/322
2004/0079308 A1* 4/2004 Diehl ..... F01L 9/02 123/90.12

(Continued)

FOREIGN PATENT DOCUMENTS

DE 3807699 A1 * 9/1989 ..... F01L 13/0015

*Primary Examiner* — Jorge L Leon, Jr.
(74) *Attorney, Agent, or Firm* — George Pappas Barrett McNagny LLP

(57) ABSTRACT

In order to ensure a simple, reliable and recuperative operation in a hydraulic drive (10) for accelerating and braking a gas exchange valve (20) of internal combustion engines or other reciprocating engines, it is proposed that a first pressure reservoir (41) for providing a first pressure $p_1$ comprises a restoring energy accumulator, preferably configured as a spring (25), and at least one hydraulic base pressure reservoir (40), which has a lower pressure $p_0$ than the first pressure reservoir (41). In a connecting line (48) between the first hydraulic pressure reservoir (41) and the working cylinder (22), a controllable opening (49) of a first valve (46) comprising at least one check valve (47) is arranged upstream or downstream in the flow path, which allows the
(Continued)

pressure medium (30) to flow in the direction of working cylinder (22), but prevents a backflow towards the pressure reservoir (41).

In order to also initiate the closing movement or to enable the breaking of the gas exchange valve in a hydraulically simple and reliable manner, in a second connecting line (58) between the first pressure reservoir (41) and the working cylinder (22) there is arranged a controllable opening (59) of a second valve (56) comprising a check valve (57), which prevents a flow in the direction of the working cylinder (22), but allows a return flow in the direction of the pressure reservoir (41).

5 Claims, 6 Drawing Sheets

(58) Field of Classification Search
USPC ..... 123/90.12, 90.13, 90.14, 90.15, 90.65, 123/90.66
See application file for complete search history.

(56) References Cited

U.S. PATENT DOCUMENTS

2004/0083995 A1* 5/2004 Diehl ..... F01L 9/02 123/90.13
2004/0089829 A1* 5/2004 Ludwig ..... F01L 9/02 251/48
2004/0144345 A1* 7/2004 Diehl ..... F01L 9/02 123/90.12
2004/0211378 A1* 10/2004 Diehl ..... F01L 9/02 123/90.13
2005/0120986 A1* 6/2005 Tai ..... F01L 9/021 123/90.13
2005/0217619 A1* 10/2005 Martinez ..... F01L 1/465 123/90.13
2011/0030630 A1* 2/2011 Rioli ..... F01L 1/465 123/90.14
2013/0074790 A1* 3/2013 Rabhi ..... F01L 9/02 123/90.11

* cited by examiner

HYDRAULIC DRIVE FOR ACCELERATING AND BRAKING DYNAMICALLY MOVING COMPONENTS

This application claims priority from PCT application No. PCT/EP2018/063075 filed May 18, 2018 which claims priority from European application No. EP 17172231.7 filed May 22, 2017, the disclosures of which are incorporated herein by reference.

TECHNICAL FIELD

The invention relates to a hydraulic drive for accelerating and braking dynamically moving components, in particular valves in gas exchange controls of internal combustion engines and other reciprocating engines.

BACKGROUND OF THE INVENTION

Variable valve controls on internal combustion engines are known as suitable means for both improving the torque curve via the rotational speed and also for improving the overall efficiency of the engine and for reducing pollutant emissions. The plurality of optimization possibilities is described in the literature.

Nowadays, a large number of mechanical, electromechanical, pneumatic and hydraulic construction possibilities for partially or fully variable valve control are known which, however, have only been successful in specific instances due to their large self energy consumption or due to high technical complexity and the associated manufacturing costs. Moreover, many such systems do not provide full variability, e.g. opening time and opening duration, or opening duration and opening stroke, may be coupled in a fixed relationship, which may severely limit the possibilities for optimizing the internal combustion engine or other reciprocating engine.

Hydraulic systems, in particular, can be built in a space-saving manner due to their high energy density (SAE-1996-0581) and are therefore particularly suitable for variable valve controls on internal combustion engines, if one manages to achieve both a low self energy consumption as well as a low system complexity and a high reliability.

Nowadays—depending on performance requirements—the following control functions can be assigned to a fully variable valve control of an internal combustion engine:

- A free, i.e. independent setting of opening and closing time points, i.e. of the so-called control timings, of the inlet and outlet valves, which can also be cylinder-selective if required. For example, the quantity of the air or fuel mixture can be controlled via the opening duration of the inlet valves.
- Fast opening and closing of the valves even at low engine rotational speeds, which means low throttle losses during gas exchange.
- A possibility of control or variation of the opening stroke which is independent from opening duration, for example at the inlet valve so as to generate a desired turbulence in the fresh gas quantity, or for example at the outlet valve so as to increase the engine braking effect, or for example at both valves so as to minimize the consumption of self energy or total energy.
- An independent and safe closure so as to avoid losses and to avoid damages due to unplanned flowthrough of hot gases, but also to avoid collisions of the gas exchange valves with each other or with the piston.

- Safe maximum stroke limitation in order to avoid collisions of the gas exchange valves with each other or with the piston.
- Electronic controllability with high robustness and low expenditure in terms of sensors and actuators.
- A gentle touchdown of the valves during the closing process.
- A disconnection of individual valves or valve groups, for example, for the purpose of spin generation or cylinder deactivation.

Hydraulic valve drives, particularly for gas exchange valves in the working chamber of an internal combustion engine, have actually been known for a long time, e.g. from German laid-open publication 1'940'177 A. They were used as an alternative to the camshaft-controlled opening of a gas exchange valve, while the closing of the valve was still provided by a spring mechanism. The resetting of the gas exchange valves by means of spring means, usually in the form of helical compression springs, is the most commonly used closing method still today, since it ensures a safe closure.

The aim of these systems was to optimize the timing of the gas exchange valve and to achieve a steeper/faster opening and closing of the valves, whereas an optimization of the self energy consumption was usually not explicitly intended. In DE 1'940'177 A, there was no provision of a stroke adjustment, but steps were taken to damp a hard impact against the mechanical stroke limit and at the touchdown point at the valve seat of the gas exchange valve by displacing the medium through a throttle cross-section.

To optimize the self energy consumption of hydraulic valve drives, various "symmetrical pendulum systems" have been proposed in which spring means are used for energy storage. DE 38 36 725 A shows a solution with mechanical spiral compression springs.

Typically, in such systems a valve mass which is symmetrically clamped between two springs performs an oscillatory movement about a central position. In the end (hold) positions, the energy is stored as spring energy. The latter is converted into kinetic energy upon build-up of movement, followed again by temporary storage in the form of spring energy at the other end position.

In the end positions, a holding or catch of the moving component must occur each time. Such symmetrical pendulum systems are demanding partly due to the fact that before startup the gas exchange valve to be driven has to be brought into one of the respective end positions. Moreover, high unidirectional forces requiring unbalanced drive forces occur during engine operation as a consequence of gas pressure, particularly in outlet valves. Energy losses caused by friction must be supplemented again by the catching devices.

In WO 93/01399 A1 it is shown that even in systems with a simple, unilaterally acting spring resetting as in DE 1'940'177 A it is possible to minimize the consumption of self energy. Thereby, the kinetic energy of movement which results from the hydraulic drive is temporarily accumulated in compression work of the unilateral, restoring spring accumulator before being used again for the closing movement.

Therefore, this principle can also be called an "asymmetric pendulum system". A disadvantage of the proposal of WO 93/01399 A1 is, for example, that each one of the actuation movements of the controlling hydraulic valve occurs amidst the movement phase, namely while the drive piston of the gas exchange valve is moving at high speed and a high-volume flow is flowing through the hydraulic valve.

In order to avoid high throttle losses in this situation, the controlling valve must be very fast. Likewise, it must switch precisely and reliably, e.g. at the opening end point of the gas exchange valve movement, so that the kinetic energy can be collected to the full extent and can be retained in the spring. These requirements thus require very demanding high-speed control valves and a demanding control electronics.

Another such asymmetric pendulum system is described in SAE 2007-24-008. The opening stroke can be adjusted independently of the controlling duration via the height of the hydraulic operating pressure. In contrast to WO 93/01399 A1, the system dispenses with high-speed switching processes of the hydraulic control valve amidst the movement phase. However, the actuation movement of the control valve in its entirety must also be precisely coordinated with the movement of the gas exchange valve. The flowpath for the opening must close precisely when the gas exchange valve has delivered its kinetic energy to the resetting spring. If the cross-section of the control valve closes too early, the movement of the gas exchange valve is braked in a lossy manner, whereas if it closes to late, the gas exchange valve is already being pushed back by the spring and is not held in the desired position, so that is then braked in a lossy manner during the return movement. To achieve this high-precision, time-accurate motion control of the hydraulic control valve, a precisely defined volumetric flow of a pilot valve is applied to a main slide. For example, the pilot valve is fed by a separate constant pressure system to provide the defined volumetric flow for controlling the main valve. Deviations of the pilot volumetric flow due to wear or clogging of the pilot valve openings, however, have an effect on the speed of the main valve and thus on the quality of the temporal coordination with the drive piston or the gas valve movement.

U.S. Pat. No. 4,009,695 A shows, among other things, the construction of a hydraulic valve drive by means of a rotary slide control valve. The slide shafts run continuously with a camshaft rotational speed (which is half the engine rotational speed) within rotary slide sleeves; in the case of the exemplary embodiment, the phase angles are adjusted in their angular phase by means of simple, relatively slow screw drives, whereas the fast processes are automatically clocked by means of the rotating slide shaft. In this manner, the engine can be operated in stationary operating points completely without control intervention; adjustments are only required when changing an operating point. In principle, such simple adjustment mechanisms can be realized even without control electronics. Unfortunately, U.S. Pat. No. 4,009,695 A does not provide for a controlling of the gas exchange valve stroke and it does not disclose any possibility of recovering hydraulically fed energy.

SUMMARY OF THE INVENTION

The object of the invention is therefore to provide a hydraulic drive for accelerating and braking dynamically moving components, in which the above-mentioned disadvantages of the prior art do not have to be accepted. The invention solves this object by means of a hydraulic drive. It is clear that the present invention is applicable particularly to gas exchange controls of internal combustion engines and other reciprocating engines. However, it results from the elements used that the drive according to the present invention is advantageous quite generally, that is to say, also for other applications in which highly dynamic masses have to be moved.

The invention presented here works—like the other aforementioned "asymmetrical pendulum systems"—also with a simple, unilateral restoring energy accumulator or spring means and with the described energy conversions. Thereby, the control system is configured advantageously in such manner that variations in speed, precision and uniformity of the control valves have hardly any influence on the hydraulic losses of the drive, which allows it to be built up from simple and robust elements.

Therefore, a truly fully variable hydraulic drive system for gas exchange valves or other highly dynamically moving masses is disclosed which keeps the self energy consumption to a minimum and is nevertheless built up in simple and reliable manner.

The invention is also well suited for a controlling process with rotary slide valves similar as described in U.S. Pat. No. 4,009,695 A. The full variability of the opening and closing time points of the gas exchange valves is kept, a stroke control is possible via the pressure level, and the self energy consumption is minimized due to energy recovery.

The advantageous embodiments of the present invention have already been partly mentioned above.

The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Further details, advantages and features of the object of the present invention will become apparent from the following description and the corresponding drawings, in which devices according to the present invention are illustrated by way of example. In these drawings.

DETAILED DESCRIPTION OF THE PREFERRED EMBODIMENTS OF THE INVENTION

Figure 1:
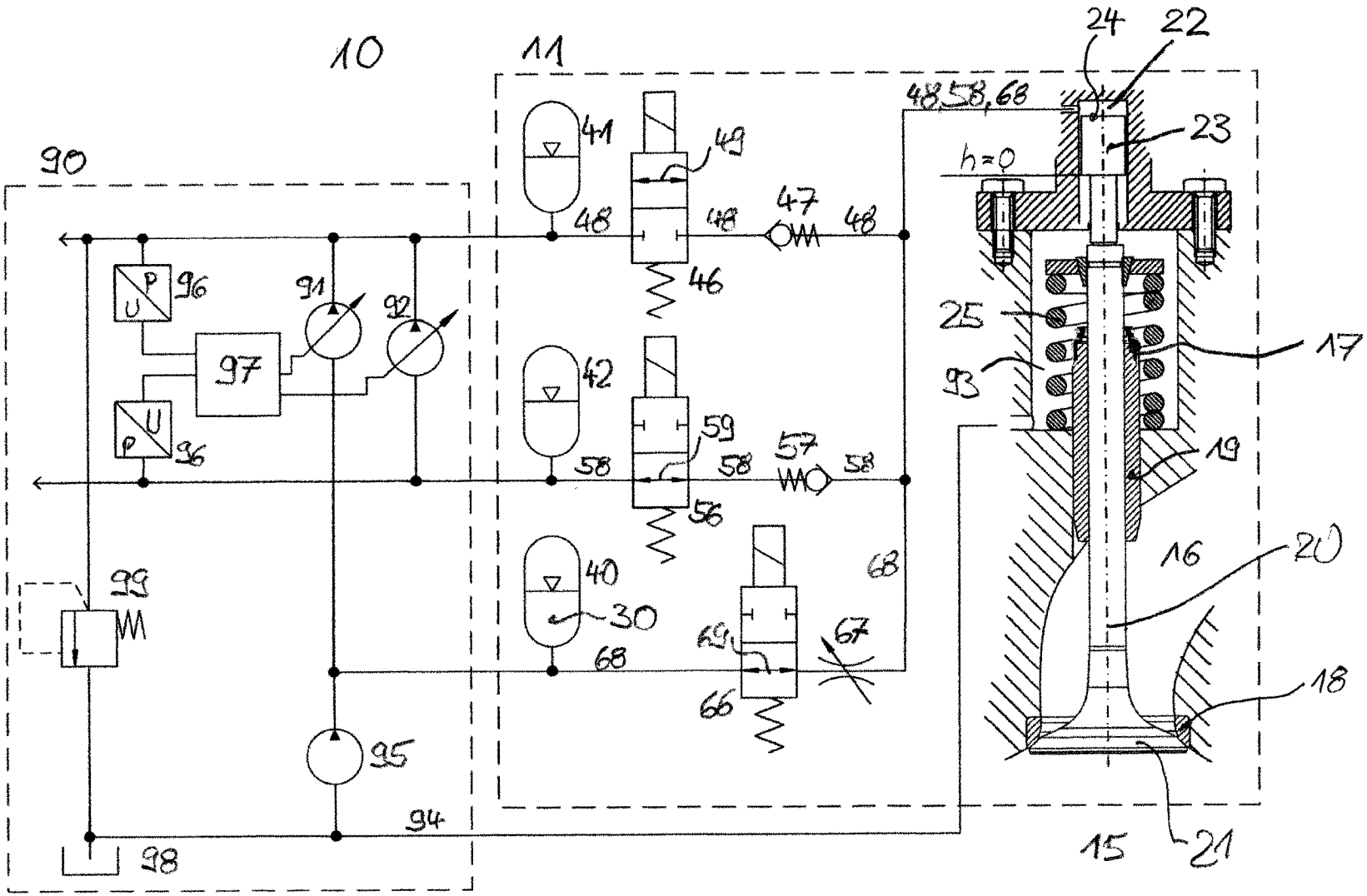
FIG. 1 shows a valve assembly for a first exemplary embodiment of the present invention comprising two 2/2-way valves, two high pressure levels and a third 2/2-way valve with an actively switched brake throttle.

In a first exemplary embodiment of the present invention—as shown in FIG. 1—a gas exchange valve 20 for an engine is operated both for opening and also for closing by means of a hydraulic drive 10 comprising a working cylinder 22 and a drive piston 23 as well as a spring 25 acting against the force movement of the drive piston.

For better understanding, the hydraulic drive 10 can be divided into a core part 11 and into a supply unit 90. In the supply unit, the provision of pressure for the proposed pressure reservoirs occurs in an inherently known manner, preferably with controllable pumps 91, 92, which allow the transported flow to be adapted to the volume flow and pressure requirement.

In this example, regulation occurs via pressure sensors 96 and a control electronics 97. The control electronics also takes the control of the actively electrically switching valves 46, 56 and 66. In this exemplary embodiment, these valves are configured as directly controlled, magnet-operated 2/2-way valves, wherein the electrical connection lines are not shown for the purpose of better overview. The supply unit also contains a pressure limiting valve 99, which protects the system against pressure overstepping and simultaneously, as will be explained below, ensures that the gas exchange stroke does not reach a critical value. In the exemplary embodiment a slightly raised base pressure $p_0$ was chosen, for which reason a small pump 95 from a collection tank 98 returns the leakage of the pressure medium 30, which was supplied via a leakage collection line 94 from the spring chamber 93, again back into the closed system. An embodiment of the base pressure reservoir as a normal, ventilated tank is also possible in principle, but the slightly raised pressure has various advantages. For example, a pressing spring is not required to bring the working piston into contact with the gas exchange valve 20. In this manner one has an inherent valve lash compensation.

Figure 4:
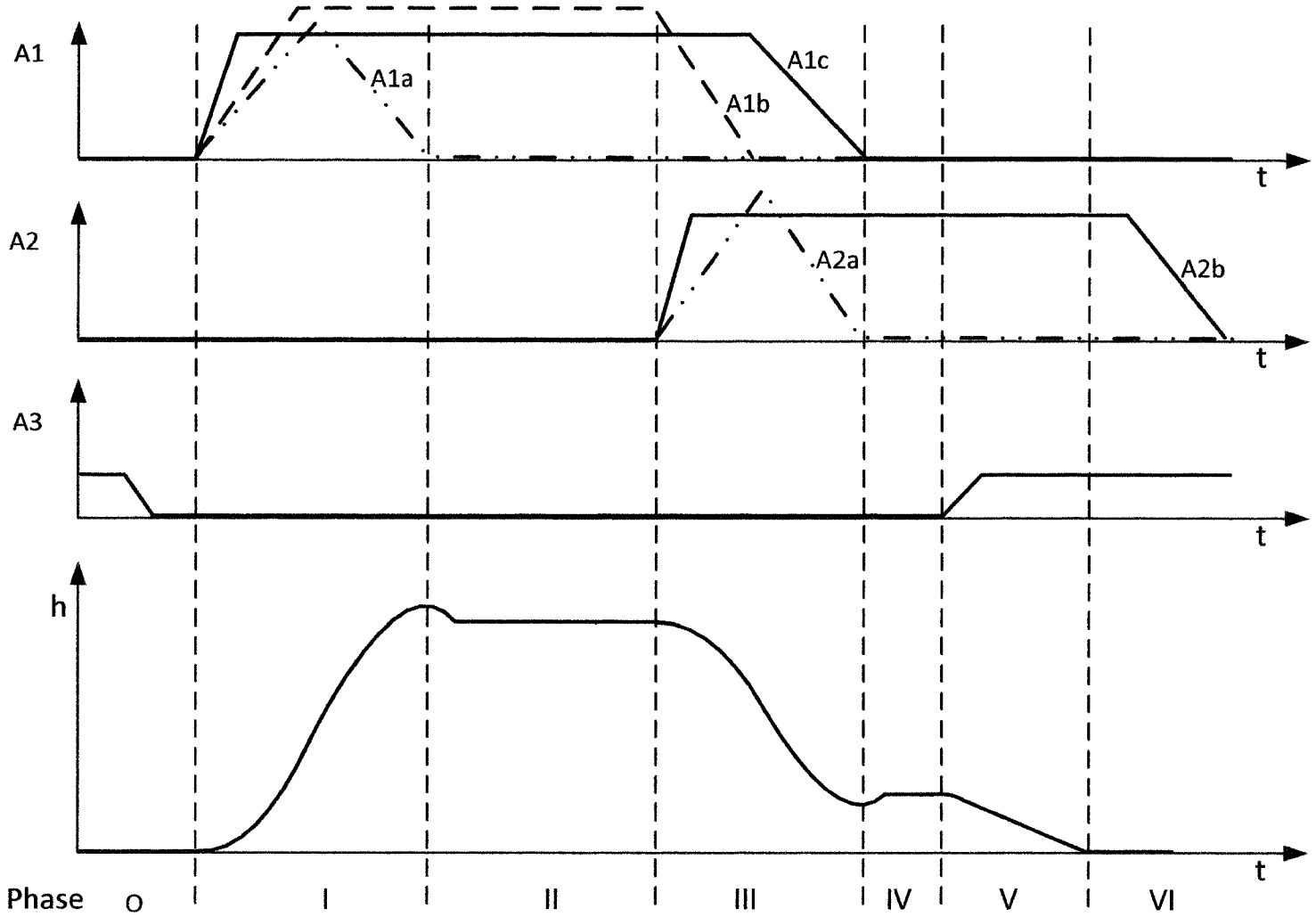
FIG. 4 shows a schematic time representation of the gas exchange valve movement phases and the opening profiles of the hydraulic control valves.

The phases of the movement sequence and the associated valve openings are shown in FIG. 4.

In the resting state—phase 0, gas exchange valve closed—the so-called third valve 66 is open and the working cylinder 22, in which the drive piston 23 with pressure acting surface 24 of the area content A is movably arranged, is connected to the base pressure reservoir 40 at the pressure level $p_0$. The biasing force $F_{Fv}$ of the spring 25 in the resting state (drive or gas exchange valve stroke h=0) is selected such that—against the opening force from the product $p_0 \times A$, but also against other opening forces e.g. on the plate 21 of the gas exchange valve 20 engaging from underpressure in the engine cylinder 15 or overpressure in the gas exchange channel 16—the gas exchange valve remains securely in the closed rest position or can reliably move back to there, even with expected frictional forces, such as e.g. from valve shaft seal 17 or valve guide 19.

It should be noted here that the mentioned engaging forces vary depending on the operating point and application type (type of internal combustion engine or reciprocating engine, inlet or outlet valve) and can also change their direction. A short time before the planned opening of the gas exchange valve, the relief valve 66 is closed.

To open the gas exchange valve 20 (phase I), the hydraulic pressure force is applied from a first pressure reservoir with the pressure $p_1$, via a first 2/2-way valve 46 and a first check valve 47, to the drive piston 23, that is to say, to its pressure acting surface 24 with area content A. The gas exchange valve 20 starts opening as soon as the hydraulic pressure force $p_1 \times A$ exceeds the biasing spring force $F_{Fv}$ of the spring 25.

It is clear that the actual force at which opening occurs can vary according to the mentioned additionally acting forces. In the case of a small proportion, the additional forces are neglected in the following formulas, or a substitute force can be used instead of $F_{Fv}$. Likewise, due to flow losses and wave processes in the working cylinder, an effective pressure that does not exactly correspond to the pressure $p_1$ will be attained in the specific embodiment. This can also be duly taken into account by means of correction values.

In the exemplary embodiment, the spring 25 which is used as an energy accumulator is configured with a high spring constant c, so that a rapid movement of the mass is achieved. The time for full opening corresponds approximately to the half period T1/2 of an oscillation of the mass-spring oscillator, which is formed by the effective mass m, namely by the mass of the gas exchange valve 20, spring plate, drive piston 23, and optionally valve bridge, a mass portion of spring 25 and of the co-swinging pressure medium 30, and of the spring 25 with spring constant c:

$$\text{i.e.: } T_{1/2} = \pi \times \text{square root}(m/c) \quad \text{(equation 1).}$$

The high spring constant c causes the spring force $F_F$ to increase markedly with increasing opening stroke h. As soon as the hydraulic force $p_1 \times A$ on the drive piston 23 has been compensated by the spring force (and any additional forces) (static equilibrium point), the movement has ended in a statical sense, but for known physical reasons—kinetic energy stored in the moving mass m—the system tends to an overshooting, which can reach twice the static stroke.

The following applies to the static stroke $h_{stat}$:

$$h_{stat}(p_1) = (p_1 \times A - F_{Fv})/c \quad \text{(equation 2)}$$

Dynamically, the double of the static stroke can be reached:

$$h_{max}(p_1) = 2 \times h_{stat}(p_1) \quad \text{(equation 3)}$$

and $$h_{max}(p_1) = 2 \times (p_1 \times A - F_{Fv})/c \quad \text{(equation 4),}$$

respectively.

From the formula it is easily seen that a desired stroke $h_{max}$ can be controlled via the amount of pressure $p_1$ but also via the magnitude of force $F_{Fv}$. In this way, a stroke control is even possible in twofold manner.

In this way, it is possible, for example, to avoid collisions of the gas exchange valve with the piston or with other valves, and to ensure a maximum desired stroke via the maximum pressure $p_1$ in a known and reliable manner by means of a pressure limiting valve, which is provided in the exemplary embodiment as pressure limiting valve 99.

Using a spring 25 with a progressive spring characteristic, the stroke control can be refined in the small stroke range, with the protection against excessive stroke becoming correspondingly robust.

The person skilled in the art also recognizes that such a progressive spring can also be provided very well as a pneumatic spring. He also recognizes that it is also possible to adjust the biasing force $F_{Fv}$ of a pneumatic spring in a particularly simple manner by adjusting its pneumatic biasing pressure. It is clear that equations 1 to 4 must undergo suitable adaptation if a progressive spring is used instead of a linear spring with a fixed spring constant c.

By means of the first check valve 47, which prevents a backflow of the pressure medium in a direction towards the pressure reservoir, the gas exchange valve 20 now remains in its open position even if the 2/2-way valve has not yet closed. At this point the holding phase (phase II) of the gas exchange valve starts. Only a minimal backward movement (closing movement) of the gas exchange valve due to a load by the pressure medium itself—which is substantially caused by its compressibility, albeit low—will be observed. Accordingly, the gas exchange of the engine can now continue with the desired stroke.

Preventively, it should be mentioned that any other flow branches or leakage paths on the flow path between the working cylinder 22 and the check valve must be prevented or closed, since these would impair the holding function. As the check valve has taken over the blocking function, the 2/2-way valve 46 can now be closed within a comparatively wide time range without the exact closing time being important. FIG. 4 shows three exemplary cross-sectional courses of the valve opening 49: $A_{1a}$, $A_{1b}$ and $A_{1c}$, all of which are possible in the exemplary embodiment. The opening of the flow cross section of the switching valve 46 only needs to occur about as quickly as the movement of the gas exchange valve occurs. Therefore, no demanding and expensive valve principle is required. Moreover, the check valve 47 automatically ensures that the kinetic energy of the moving mass is almost completely converted into spring energy and also remains temporarily stored in the spring 25—both of which would only be achievable with great effort in case of using an active control intervention of the valve 46.

It should be noted that in this phase a pressure is established in the working cylinder 22, which—as a result of the overshoot and the stored spring energy—is generally higher than the pressure $p_1$ FIG. 1 also shows the closing process of the gas exchange valve 20, phase 3, by means of a further part of the hydraulic drive. For this purpose, the second 2/2-way valve 56 is opened. The person skilled in the art should be advised that this second 2/2-way valve was closed so far (in phase I and II) (FIG. 4, course $A_2$). The valve 56 is connected to a second pressure reservoir 42 with a pressure $p_2$, which is generally lower than the pressure $p_1$ but higher than $p_0$. A hydraulic flow occurs into the pressure reservoir 42, while the drive piston 23 executes the closing movement (FIG. 4, stroke diagram, phase III). If now the pressure in the working cylinder 22 drops below the pressure $p_2$, the hydraulic backflow is terminated, namely by the second check valve 57, which of course is arranged in the other direction than the first check valve and prevents the backflow from the pressure reservoir 42 into the working cylinder. As a result—in a similar manner as the check valve 47 during opening of the gas exchange valve—the gas exchange valve remains in the position reached and the 2/2-way valve must only be closed later, at any time point before the next gas exchange valve opening cycle (FIG. 4, $A_{2a}$, $A_{2b}$). In particular, this automatism recuperates a maximum of energy. Because there is no need for a precise closing, the valve 56 can also be constructed in a simple manner, and the effort of the electronic control is considerably reduced. The control valve 56 in turn, is also allowed to switch comparatively slowly, which means that in many cases it can be dispensed with demanding construction using e.g. eddy current-inhibiting magnet probe materials.

Finally, it should be mentioned that the late closing is very helpful for the using of rotary slide technology, because remaining open of the cross-section for different lengths is not a problem.

In principle, it would be possible to adjust the pressure level $p_2$ in such manner that the gas exchange valve closes exactly at this working point, that is to say, that it touches down on its seat at a speed close to zero. However, this is not so easy and, particularly in the case of an outlet valve of an internal combustion engine, this working point is also not the same for all operating states. For this reason, in the exemplary embodiment shown in FIG. 1, the pressure $p_2$ is chosen in such manner that the process of backflow through the second 2/2 way valve 56 into the pressure reservoir 42 is terminated at a certain distance before the point of touchdown of the gas exchange valve 20 (FIG. 4, transition of phase III-IV).

The touchdown of the gas exchange valve 20—i.e. the closing leading from the «stopping point» to the valve seat (phase V)—is made possible in the exemplary embodiment shown in FIG. 1 by the fact that a third 2/2-way valve 66 opens a flow path from the working cylinder 22 to the base pressure reservoir by means of a connecting line 68. In series thereto, there is a brake throttle 67, by means of which the speed of the touchdown process can be controlled. The force required for safe closing and touchdown of the gas exchange valve is obtained from the remaining energy of the spring 25, which is configured in such manner that the closing force in the touchdown point, which is equal to the spring biasing force $F_{Fv}$, is larger than the product of the pressure $p_0 \times A$ and other opening forces, as already described above.

The switching time point of the third 2/2-way valve 66 (FIG. 4, $A_{V3}$, beginning of phase V) determines the resting time in the holding phase in the proximity of the valve seat (phase IV). In the case of internal combustion engines and other reciprocating engines a resting at his point is often not desirable, the closing process of a gas exchange valve should be completed quickly. Due to the fact that the system is an oscillation system, the duration of phase III (beginning of the closing movement of the gas exchange valve up to the stopping point) corresponds approximately to half the period $T_{1/2}$ of the spring-mass oscillator according to equation 1.

The electronic control can be programmed in such manner that the opening of the 2/2-way valve 66 begins by $T_{1/2}$ later than the opening of the 2/2-way valve 56. In this context, a person skilled in the art will choose in many cases a slightly longer time duration so as to be on the safe side with regard to maximum energy recovery.

Figure 5:
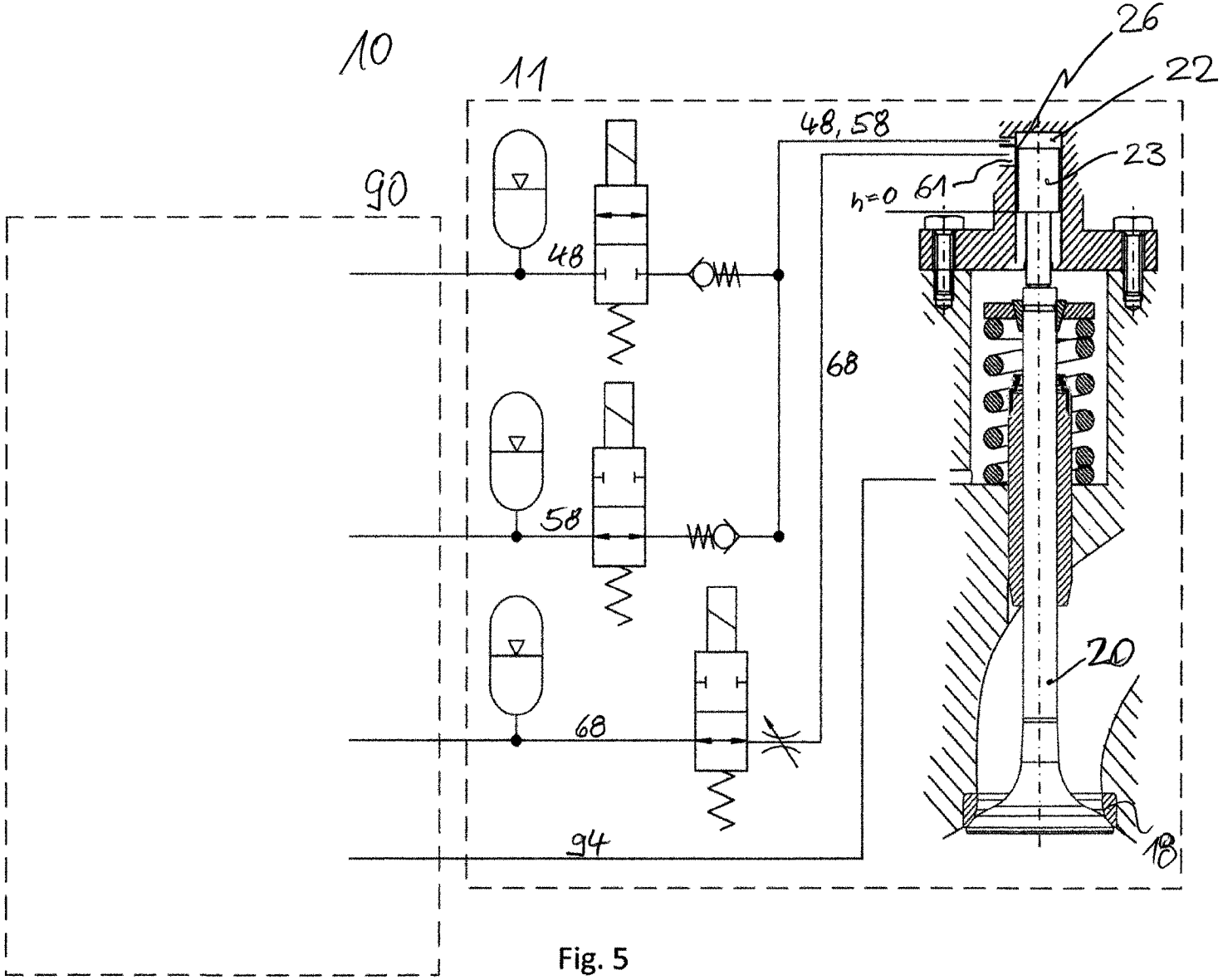
FIG. 5 shows a variant of the exemplary embodiment 1 in a fragmentary representation

For reasons of noise and wear, a particularly gentle touchdown of the gas exchange valves on the valve seats is desired. For this purpose, the exemplary embodiment according to FIG. 1 can be equipped with a path-controlled braking device, as shown sectionwise in FIG. 5.

For this task, the connecting line 68 must be guided into the working cylinder 22 separately from the other connecting lines 48 and 58, so that the transition cross section 61 from the working cylinder into the connecting line 68—when the working piston 23 approaches the position h=0 or the gas exchange valve 20 approaches the valve seat 18—is closed by the control edge 26 of the working piston so far that the gas exchange valve is braked strongly and moves into the seat gently. It is clear to the person skilled in the art that the transition cross section can be suitably configured, e.g. with a notched contour in the wall of the working cylinder, or as a bore or groove in the drive piston.

Figure 6:
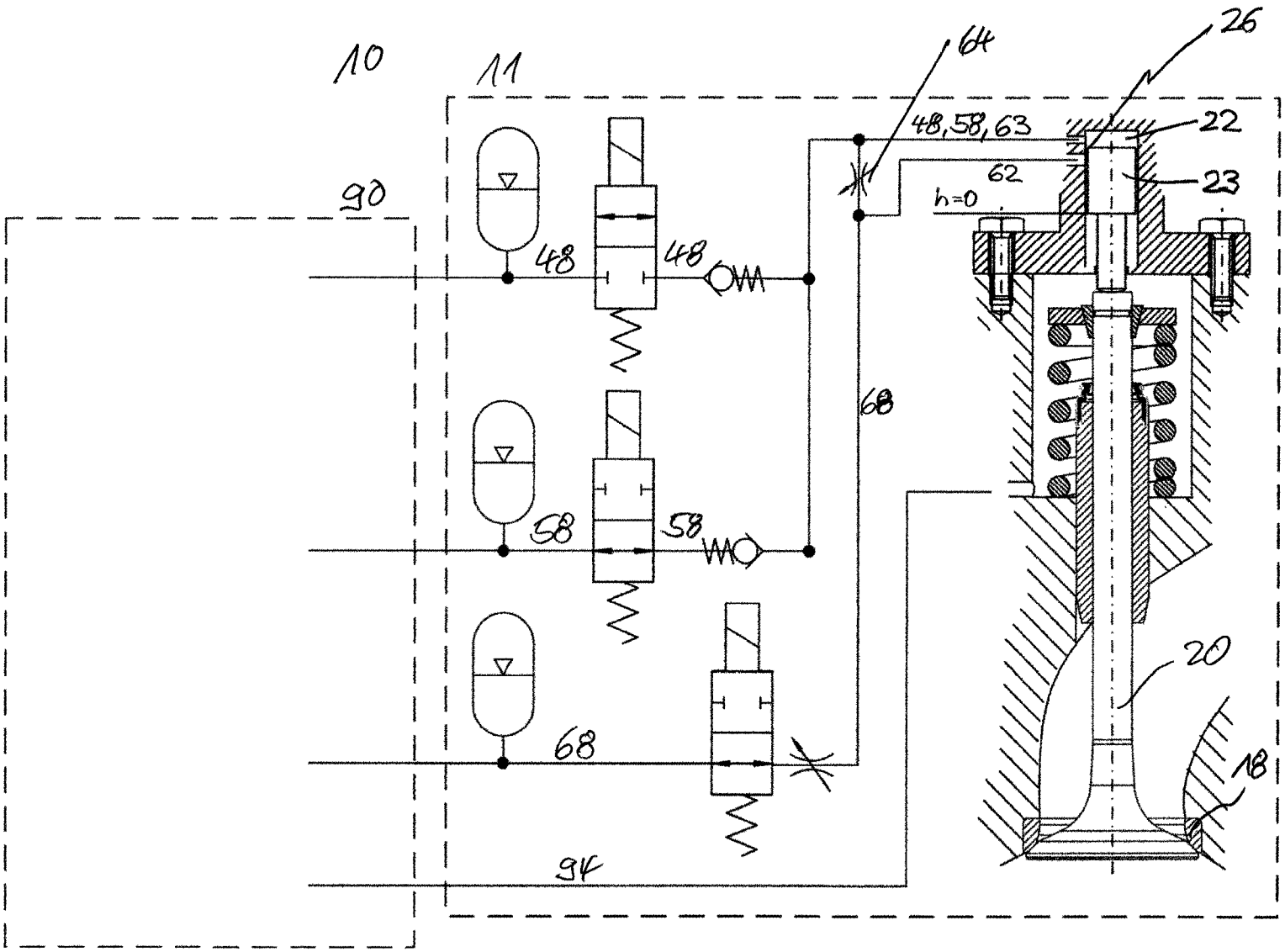
FIG. 6 shows a further variant of the exemplary embodiment 1 in a fragmentary representation

In FIG. 6 it is shown sectionwise how the soft braking can be carried out in alternative manner. In this case, the connecting line 68 is divided into two connections 62 and 63, wherein the first connection 62 is shut off by the control edge 26 of the drive piston 23 at the latest in the proximity of stroke zero, i.e. shortly before touchdown of the gas exchange valve 20 on the valve seat 18, so that the pressure medium can only flow via the connection 63 and the throttle 64. This can also be arranged in the working piston.

Finally, the exemplary embodiment according to FIG. 1 can be advantageously configured with rotary slide valves. Thereby, the 2/2-way valves 46, 56 and 66 are each replaced by a rotary slide valve. The adjustment is carried out by adjusting the phase angle. Due to the fact that, by virtue of the automatic holding function of the check valves 47 and 57 according to the present invention, only the opening time point is important for the control of the flow paths 49 and 59 in each direction of movement, whereas the closing time point may lie in a comparatively wide actuation range, it does not matter—at least to a certain extent—when the closing time point is co-shifted as a consequence of phase rotation. Accordingly, the invention allows building up a fully variable and energy-efficient hydraulic gas exchange valve drive also with rotary slide valves which are running in cycle-synchronous manner with the internal combustion engine.

Figure 2:
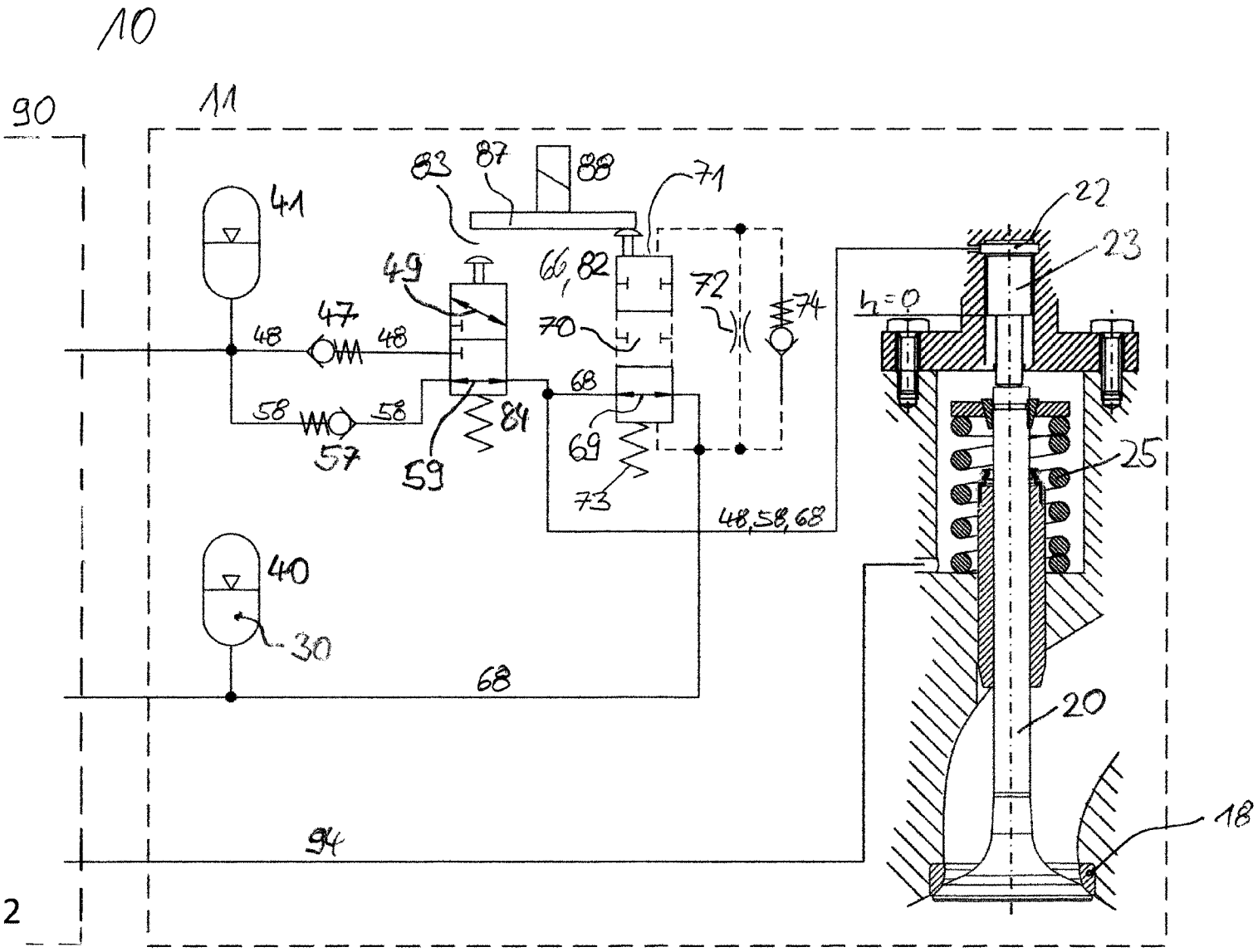
FIG. 2 shows a valve assembly for a second exemplary embodiment of the present invention comprising a high-pressure level, a 3/2-way valve and an automatic hydraulically time-controlled brake throttle.

In the second exemplary embodiment according to FIG. 2, only one high-pressure reservoir, namely pressure reservoir 41 with pressure $p_1$, is used.

Due to this fact, $p_2=p_1$. This embodiment variant can be advantageously used, in particular, if there is a sufficiently large cross-sectional configuration of all hydraulic valves and connecting lines and a friction-optimized configuration of the movable elements (drive piston 23 in the drive cylinder 22 and gas exchange valve 20 in the valve guide 19 with valve shaft seal 17), because with low energy losses a backswing up to the proximity of the valve seat occurs. As a result, the construction effort is reduced overall.

As a further simplification, the 3/2-way valve 84 is used, whereby in this case the check valves 47 and 57 are arranged between the 3/2-way valve and the pressure reservoir 41. The opening of the gas exchange valve (phase I) is initiated by activating of the actuator 88, the holding open (phase II) is achieved in a known manner by the check valve 47, and the closing of the gas exchange valve is initiated by deactivating of the actuator 88. Finally, the second holding phase occurs in proximity of the seat in a known manner by means of the check valve 57.

In another embodiment, the third valve 66 is configured as a hydraulically time-controlled valve 86. In this case, it is co-operated by a follower 87 of the actuator 88. This follower is configured in such manner that upon energizing the actuator 88, the valve cross section 69 of the valve 82 is first closed before the 3/2-way valve is moved appreciably, so that upon opening of the cross section 49 no unnecessary short circuit from the pressure reservoir 41 to the base pressure reservoir 40 arises. This is achieved by the clearance 83 between follower and valve part of the 3/2-way valve.

The time-controlling of valve 82 works as follows:

Upon deactivation of the actuator 88, i.e. upon initiation of the closing phase of the gas exchange valve, by pulling back the follower next to the 3/2-way valve, the resetting of the valve 82 is also released.

However, the movement by the resetting spring 73 is slow, because the pressure medium must be pressed through the throttle 72 across a pressure acting surface 71 of the valve. In this situation, the check valve 74 which here is arranged parallel to the throttle 72 has a blocking function. The throttle, pressure acting surface and spring force are adjusted in such manner that the cross-section 69 opens towards the base pressure reservoir only after the desired time delay. Again, the time delay is chosen to be somewhat more generous compared to half the period of the spring-mass-oscillator. As a result, one is on the safe side regarding optimum energy recovery, which is ensured by the automatic holding function of the check valve 57.

When the actuator is deactivated, the 3/2-way valve 84, controlled by its resetting spring, performs a rapid movement into its resting position 0. However, the parallel switched 2/2-way valve 82 resets slowly, because its resetting movement is braked by the throttle 72. The opening movement occurs without braking, through a check valve 74.

Figure 3:
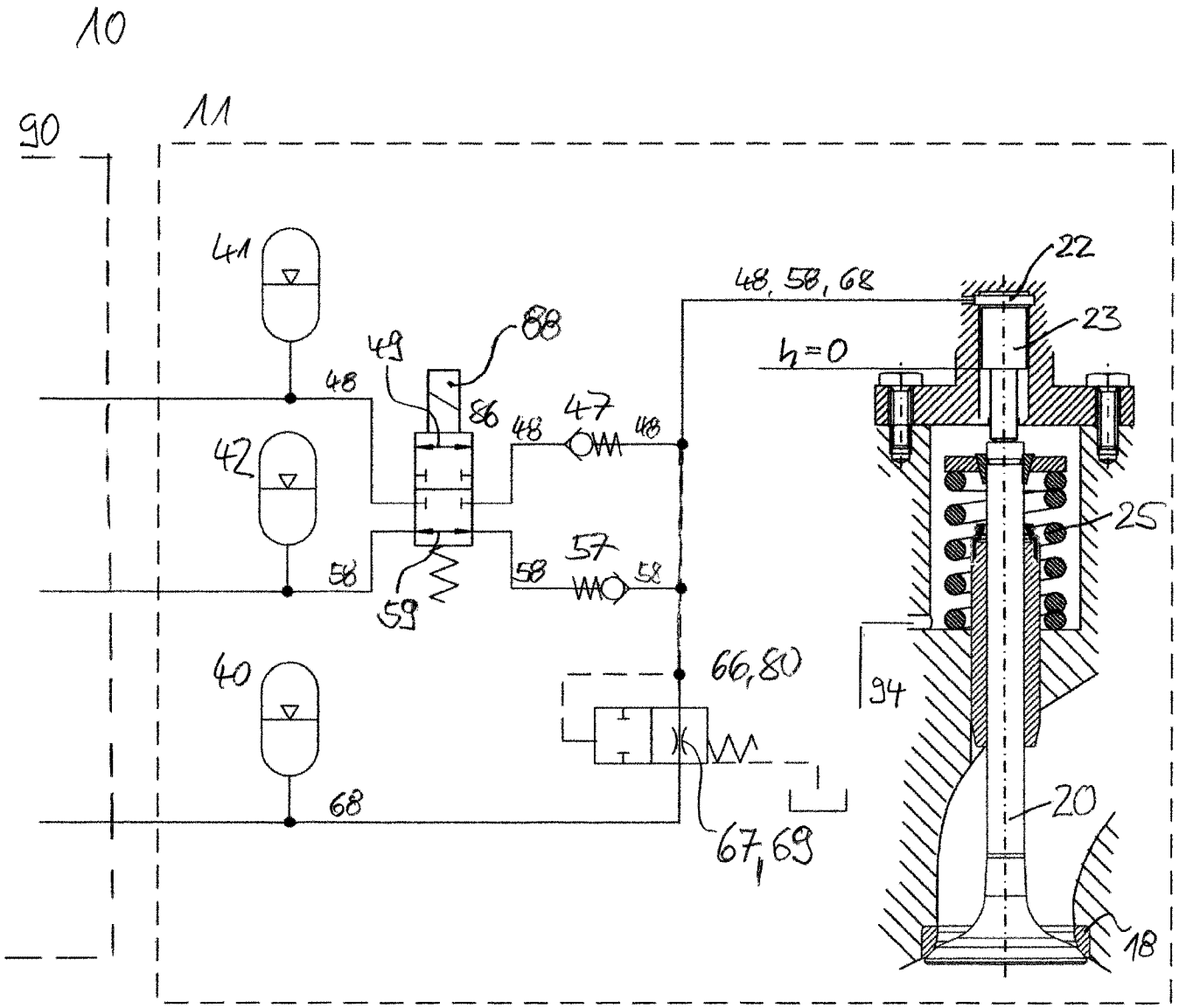
FIG. 3 shows a valve assembly for a third exemplary embodiment of the present invention comprising a 4/2-way valve, two high pressure levels and an automatic pressure-controlled brake throttle.

In the third exemplary embodiment according to FIG. 3, the 4/2-way valve 86 is used. This is again suitable for the use of two high pressure levels. Furthermore, the third valve 66 is arranged in the pressure-controlled embodiment 80 in the connecting line 68 between the working cylinder and the base pressure reservoir. The valve 80 uses the effect that the gas exchange valve 20 slightly springs back during the transition from phase III to phase IV, similar to the transition from phase I to II, i.e. it tends to open again, whereby an underpressure is generated in the working cylinder 22. As a result, the pressure-controlled valve 80 is opened and the desired connection to the base pressure reservoir is produced via the throttle 67, which is integrated in the cross section 69.

LIST OF REFERENCE NUMERALS

10 hydraulic drive
11 core part of the drive
15 engine cylinder
16 gas exchange channel
17 valve shaft seal
18 valve seat
19 valve guide
20 gas exchange valve
21 plate of the gas exchange valve
22 working cylinder
23 drive piston
24 pressure acting surface of the drive piston 23
25 spring
26 control edge of the drive piston
30 pressure medium
40 base pressure reservoir with pressure level $p_0$
41 first pressure reservoir with pressure level $p_1$
42 second pressure reservoir with pressure level $p_2$
46 first valve
47 first check valve
48 first connection line
49 controllable opening of the first valve 46
56 second valve
57 second check valve
58 second connection line
59 controllable opening of the second valve 56
61 transition cross section of working cylinder 22 in the connecting line 68
62 first connection of the connecting line 68 on the working cylinder 22
63 second connection of the connecting line 68 on the working cylinder 22
64 throttle in the second connection 63
66 third valve
67 throttle
68 connection line of working cylinder 22 with base pressure reservoir 40
69 controllable opening of the third valve 66
70 closed intermediate position of the third valve 66
71 pressure acting surface of the third valve 66
72 throttle of the third valve 66
73 spring for resetting the third valve 66
74 check valve
80 embodiment of the third valve 66 as a pressure-controlled valve
82 embodiment of the third valve 66 as a hydraulically time-controlled valve

83 clearance between follower 87 and valve part of 3/2-way valve 84
84 3/2-way valve
86 4/2-way valve
87 follower of the actuator
88 mutual actuator
90 pressure medium supply unit
91 pump for first pressure reservoir
92 pump for second pressure reservoir
93 spring chamber
94 leakage collection line
95 pump for feedback of the leakage
96 pressure sensor
97 electronics
98 collection container
99 pressure limiting valve
A area content of the pressure acting surface 24 of the drive piston 23
$p_0$ pressure of the base pressure reservoir 40
$p_1$ pressure of the first pressure reservoir 41
$p_2$ pressure of the second pressure reservoir 42
Remark: all pressures shall be understood relative to ambient pressure.
h stroke of gas exchange valve 20 or of drive piston 23, respectively
$h_{max}$ maximum opening stroke
$h_{stat}$ theoretical static opening stroke
m effective mass of moving component
(=Sum of the masses of:
gas exchange valve comprising spring plate and, optionally, valve bridges etc.
mass of drive piston 23
mass proportion of spring 25
mass proportion of co-moving pressure medium 30
further co-moving parts such as valve bridge, etc.)
$F_F$ spring force of spring 25, dependent on spring deflection
$F_{Fv}$ biasing force of spring 25 (in the closed position of the gas exchange valve, h=0)
c spring constant of spring 25 (for a linear characteristic)
t time
$T_{1/2}$ half period duration of the spring mass oscillator from m and c phases:
O resting phase
I opening of the gas exchange valve
II first holding phase in the open state
III closing of the gas exchange valve
IV second holding phase in front of valve seat
V final closing of the gas exchange valve
VI resting phase
$A_{1a}$, $A_{1b}$, $A_{1c}$ cross-sectional course variants a, b, c of the first valve
$A_{2a}$, $A_{2b}$ cross-sectional course variants of second valve
$A_3$ cross-sectional course of third valve

The invention claimed is:

1. A hydraulic drive for accelerating and braking dynamically moving components in gas exchange controls of a reciprocating engine, the hydraulic drive comprising:
at least one gas exchange valve of the engine;
a working cylinder with a pressure acting surface of a drive piston,
at least one first pressure reservoir configured to provide a first pressure of a hydraulic pressure medium,
at least one second pressure reservoir configured to provide a second pressure of the hydraulic pressure medium,
at least one restoring energy accumulator with a biasing force which engages the at least one gas exchange valve,
at least one hydraulic base pressure reservoir configured to provide a base pressure that is less than the first pressure,
wherein in a first connecting line between the at least one first pressure reservoir and the working cylinder there is provided a controllable opening of a first valve comprising at least one spring-loaded check valve allowing the pressure medium to flow towards the working cylinder and preventing a backflow towards the at least one first pressure reservoir,
wherein in a second connecting line between the at least one second pressure reservoir and the working cylinder there is provided a controllable opening of a second valve comprising at least one spring-loaded check valve preventing a flow of the pressure medium towards the working cylinder and allowing a backflow towards the at least one second pressure reservoir, and wherein the second pressure is greater than the base pressure and less than the first pressure.

2. The hydraulic drive according to claim 1, wherein the biasing force of the at least one restoring energy accumulator is adjustable.

3. The hydraulic drive according to claim 1, wherein the at least one restoring energy accumulator is configured with a progressive spring characteristic.

4. A hydraulic drive for accelerating and braking dynamically moving components in gas exchange controls of a reciprocating engine, the hydraulic drive comprising:
at least one gas exchange valve of the engine;
a working cylinder with a pressure acting surface of a drive piston,
at least one first pressure reservoir configured to provide a first pressure of a hydraulic pressure medium,
at least one second pressure reservoir configured to provide a second pressure of the hydraulic pressure medium,
at least one restoring energy accumulator with a biasing force which engages the at least one gas exchange valve,
at least one hydraulic base pressure reservoir configured to provide a base pressure that is less than the first pressure,
wherein in a first connecting line between the at least one first pressure reservoir and the working cylinder there is provided a controllable opening of a first valve comprising at least one spring-loaded check valve allowing the pressure medium to flow towards the working cylinder and preventing a backflow towards the at least one first pressure reservoir,
wherein in a second connecting line between the at least one second pressure reservoir and the working cylinder there is provided a controllable opening of a second valve comprising at least one spring-loaded check valve preventing a flow of the pressure medium towards the working cylinder and allowing a backflow towards the at least one second pressure reservoir,
wherein in a third connecting line between the working cylinder and the at least one base pressure reservoir there is provided a third controllable opening of a third valve, and
wherein the third controllable opening opens in a time-controlled manner shifted by a predetermined time after opening of the second valve, the predetermined time being selected such that the second check valve is returned to a closed position and the at least one gas exchange valve is held at a current position.

5. The hydraulic drive according to claim 4, wherein the third valve has a closed intermediate position and during the opening of the second valve a resetting movement of the third valve, which is driven by a spring, is unlocked and started, whereby pressure medium is displaced via a pressure acting surface of the third valve and driven through a throttle such that a flow of the pressure medium through the intermediate position is restricted and a cross-section of the third connecting line opens only after a predetermined delay time.

* * * * *